US008800960B2

(12) United States Patent
Hsu

(10) Patent No.: US 8,800,960 B2
(45) Date of Patent: Aug. 12, 2014

(54) AUTOMATIC WATER SUPPLY CONTROL DEVICE

(71) Applicant: Ching-Yen Hsu, New Taipei (TW)

(72) Inventor: Ching-Yen Hsu, New Taipei (TW)

( * ) Notice: Subject to any disclaimer, the term of this patent is extended or adjusted under 35 U.S.C. 154(b) by 185 days.

(21) Appl. No.: 13/633,949

(22) Filed: Oct. 3, 2012

(65) Prior Publication Data

US 2014/0090720 A1 Apr. 3, 2014

(51) Int. Cl.
*F16K 31/02* (2006.01)

(52) U.S. Cl.
USPC ..... 251/129.04; 137/599.01

(58) Field of Classification Search
USPC ..... 137/599.01; 251/129.04
See application file for complete search history.

(56) References Cited

U.S. PATENT DOCUMENTS 3,751,736 A * 8/1973 Egli ..... 4/305
7,075,768 B2 * 7/2006 Kaneko ..... 361/160
2002/0121617 A1 * 9/2002 Hu ..... 251/129.04
2002/0171056 A1 * 11/2002 Paese et al. ..... 251/129.04
2004/0041110 A1 * 3/2004 Kaneko ..... 251/129.04
2012/0137426 A1 * 6/2012 Wang ..... 4/623
2012/0246814 A1 * 10/2012 Huang ..... 4/313

FOREIGN PATENT DOCUMENTS

TW M404399 U1 5/2011

* cited by examiner

*Primary Examiner* — John K Fristoe, Jr.
*Assistant Examiner* — Reinaldo Sanchez-Medina
(74) *Attorney, Agent, or Firm* — Lin & Associates IP, Inc.

(57) ABSTRACT

An automatic water supply control device is disclosed. A power processing unit processes an alternating current outputted by a micro hydro generator and provides a stable direct current. The automatic water supply control device uses a capacitor and a capacitor matrix for storing electric energy. A sensing unit detects changes from an environment such as human proximity, temperature and humidity and outputs sensing signals. A micro controller set receives the sensing signals sent by the sensing unit in order to control an electromagnetic drive unit and drive the electromagnetic coil. The micro controller set also controls an electromagnetic drive unit to drive an electromagnetic coil for supplying water and performing charging based on a logical setting, when an output voltage value of a step-down voltage conversion circuit is lower than a preset voltage value.

6 Claims, 2 Drawing Sheets

AUTOMATIC WATER SUPPLY CONTROL DEVICE

BACKGROUND OF THE INVENTION

1. Field of the Invention

The present invention relates to an automatic water supply control device, and in more particular, relates to an automatic water supply control device having a capacitor matrix.

2. The Prior Arts

As human living standard is elevated, high quality of living is even more demanded than ever before. Convenient, comfortable, hygienic and human oriented bathroom equipment such as automatic toilet seat lifting device, induction type faucet by which water is flowed out by sensing the presence of hands without having to touch the tap and automatic sensor urinal flushing device are commonly used in public places because they are convenient to use, hygienic and water-saving.

Generally, common automatic water supply devices are usually powered by battery or direct current converted from commercial power. Battery has the drawback that it has to be changed very often, while wiring and construction are required for municipal electricity which is troublesome.

In order to solve the above drawbacks, hydro generator is used in flushing controller for automatic sensor urinal funnel so that energy can be used more efficiently, and battery and complicated construction are not required.

When a person uses the automatic sensor urinal funnel with flushing controller, the infrared sensor detects the proximity of the human body. If the activating conditions are met, the electromagnetic valve will be controlled by the micro controller to turn on the water supply to flush water or turn off the water supply based on the preset procedures. Electric energy is generated by the hydro generator through the flushing of water and the electric energy is stored. When the time accumulated after a continuous period of no flushing meets the preset conditions, the micro controller detects the voltage of an internal single large-sized capacitor. If the detected voltage is lower than a preset value, the electromagnetic valve will be controlled by the micro controller to turn on the water supply to flush water or turn off the water supply based on the preset procedures. Therefore, the electric energy stored in the electric energy storage unit can be maintained above a safety value set in the micro controller.

Taiwanese patent publication No. M404399 discloses using a capacitor as a main electric energy storage unit, a hydro generator as a main electric generating unit, an electronic controlling unit for monitoring the voltage of the capacitor and driving an electric control valve to turn on a water current passage to flush water or turn off the water current passage based on the preset operational procedures when the voltage of the capacitor is lower than a range set in the electronic controlling unit. Furthermore, an automatic sensor flushing control device is disposed with a water current passage which can be opened or closed independently by the electric control valve or a manual control valve so that the water current can be supplied or cut off by the electric control valve or the manual control valve independently. Therefore, flushing can be performed manually in an abnormal situation. However, if the single large sized capacitor used as the electric energy storage unit is required to be low self-discharged, its instantaneous discharge will be slow. When the amount of electricity stored in the single large sized capacitor is low or when there is a malfunction, it will not be able to provide a large electric current momentarily demanded by the electromagnetic valve, and therefore the micro controller will not be able to determine if the electromagnetic valve can operate normally in order to flush water. Therefore, such design is usually used with the manual control valve so that the hydro generator can generate electricity to charge the single large sized capacitor.

In view of the above, an automatic water supply control device which is structurally simple and can be easily installed is disclosed in the present invention for improving the problem of slow instantaneous discharge of the single large sized capacitor.

SUMMARY OF THE INVENTION

A main objective of the present invention is to provide an automatic water supply control device which can effectively improve the problem of slow instantaneous discharge of single large sized capacitor, and can achieve flushing without having to turn on a valve manually while the amount of electricity stored in the single large sized capacitor is insufficient for operation or the single large sized capacitor is malfunctioned.

In order to achieve the above objectives, an automatic water supply control device of the present invention comprises a power processing unit, a capacitor, a capacitor matrix, a step-down voltage conversion circuit, an electromagnetic drive unit, a sensing unit and a micro controller set. The power processing unit processes an alternating current outputted by a micro hydro generator and provides a stable direct current. The capacitor is electrically connected to the power processing unit for storing electric energy. The capacitor matrix is in parallel connection with the capacitor and is separated from the capacitor by using a diode. The capacitor matrix is composed of more than two capacitors which are different from the capacitor and provides the electric energy required by the electromagnetic drive unit and the step-down voltage conversion circuit based on the direct current. The step-down voltage conversion circuit is electrically connected to the capacitor matrix and the micro controller set for converting the voltage of the direct current and providing a direct current with a voltage lower than that of the power processing unit. The electromagnetic drive unit is electrically connected to the capacitor matrix and the micro controller set. The driving electric energy required by the electromagnetic drive unit is provided by the capacitor matrix and it is controlled by the micro controller set. The sensing unit is electrically connected to the micro controller set for sensing changes from the environment such as human proximity, temperature and humidity and outputting sensing signals. The micro controller set is electrically connected to the step-down voltage conversion circuit, the electromagnetic drive unit and the sensing unit for controlling the electromagnetic drive unit and driving an electromagnetic coil based on the sensing signals sent by the sensing unit. The micro controller set also controls the electromagnetic drive unit and drives the electromagnetic coil to supply water and to perform charging based on a logical setting when a voltage value of the step-down voltage conversion circuit is lower than a preset voltage value. The step-down voltage conversion circuit is composed of a low dropout regulator (LDO regulator) and the capacitor is a super capacitor or an electric double layer capacitor. The capacitor matrix is composed of more than two capacitors which are different from the capacitor.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

An automatic water supply control device of the present invention will be described in details through an embodiment. The automatic water supply control device comprises a capacitor and a capacitor matrix for storing electric energy. Besides, a micro controller set of the automatic water supply control device receives sensing signals sent by a sensing unit in order to control an electromagnetic drive unit and drive an electromagnetic coil. The micro controller set also controls the electromagnetic drive unit and drives the electromagnetic coil to supply water and to perform charging based on a logical setting when an output voltage value of the step-down voltage conversion circuit is lower than a preset voltage value. However, the embodiment of the present invention should not be construed as a limitation to any specific environments, applications and special methods used to embody the automatic water supply control device. Therefore, the descriptions of the embodiment thereof are only used for describing the objects of the present invention rather than limiting it. It should be noted that, in the embodiment and drawings below, elements not directly related to the present invention are omitted; and for the sake of simplicity, the dimensions of elements are not illustrated according to actual ratios.

Figure 1:
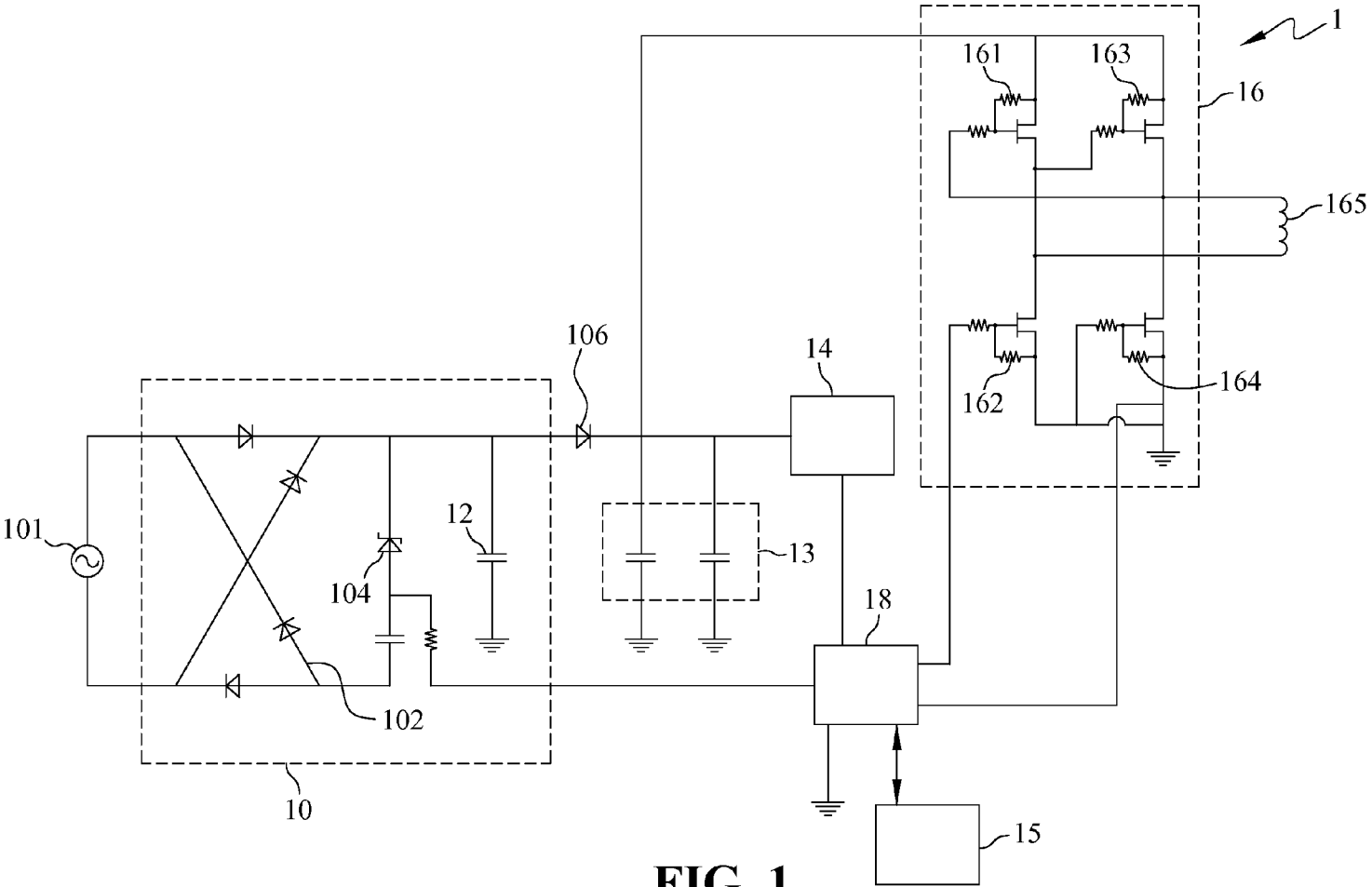
FIG. 1 is a circuit diagram of an automatic water supply control device according to an embodiment of the present invention.

FIG. 1 is a circuit diagram of an automatic water supply control device according to an embodiment of the present invention. An automatic water supply control device 1 comprises a power processing unit 10 for processing an inputted alternating current 101 generated by a micro hydro generator disposing in a water current passage. The micro hydro generator generates electric energy by harnessing energy from the flowing of water current. The power of electric generation of the micro hydro generator must meet the amount of generated electric for actuating, which means the power of electric generation must be larger than the standby mode in order to activate flushing of water and balance out the amount of electricity consumed. The principles of electricity generation is based on using the water current to drive the vanes of the micro hydro generator, and the mechanical energy of the operation of the vanes is converted into electric energy for generating the alternating current 101 for the power processing unit 10.

The inputted alternating current 101 is converted into a direct current after the rectification by a full-wave bridge rectifier 102. A Zener diode 104 is acted as a protection element for setting a constant voltage for the direct current so that the voltage is regulated or stabilized in order to ensure that an output of the full-wave bridge rectifier 102 does not exceed a maximum preset voltage of a capacitor 12.

The capacitor 12 is electrically connected to the power processing unit 10 for storing electric energy. A capacitor matrix 13 is in parallel connection with the capacitor 12 and is separated from the capacitor 12 by using a diode 106. The capacitor matrix 13 is composed of more than two capacitors which are different from the capacitor 12 and provides the electric energy required by an electromagnetic drive unit 16 and a step-down voltage conversion circuit 14 based on the direct current. The capacitor 12 is a super capacitor or an electric double layer capacitor. The capacitor 12 is charged by the direct current outputted by the power processing unit 10 after the rectification.

The capacitor matrix 13 and the capacitor 12 can be coordinated for allocating the electric energy stored in them and providing the electric energy required by the electromagnetic drive unit 16 and various circuit elements.

The step-down voltage conversion circuit 14 is electrically connected to the capacitor matrix 13 and a micro controller set 18 for converting the voltage of the direct current and providing a direct current with a voltage lower than that of the power processing unit 10. In the direct current circuit, the step-down voltage conversion circuit 14 converts the voltage of the direct current and provides direct currents with different voltages to meet the different requirements for driving the various elements. The step-down voltage conversion circuit 14 is a low dropout regulator (LDO regulator).

The electromagnetic drive unit 16 is electrically connected to the capacitor matrix 13 and the micro controller set 18. The driving electric energy required by the electromagnetic drive unit 16 is provided by the capacitor matrix 13 and it is controlled by the micro controller set 18. The electromagnetic drive unit 16 can be composed of four transistor switches 161 to 164 connected as a bridge circuit (H bridge), or can be composed of elements packaged as an IC. The four transistor switches 161 to 164 are connected to corresponding ends of an electromagnetic coil 165. The electromagnetic drive unit 16 is preset to ON in the initial status and abnormal status.

A sensing unit 15 is electrically connected to the micro controller set 18 for sensing changes from the environment such as human proximity, temperature and humidity and outputting sensing signals. The micro controller set 18 is electrically connected to the step-down voltage conversion circuit 14, the electromagnetic drive unit 16 and the sensing unit 15 for controlling the electromagnetic drive unit 16 and driving the electromagnetic coil 165 based on the sensing signals sent by the sensing unit 15. The micro controller set 18 also controls the electromagnetic drive unit 16 and drives the electromagnetic coil 165 to supply water and to perform charging based on a logical setting when an outputted voltage value of the step-down voltage conversion circuit 14 is lower than a preset voltage value. Furthermore, the micro controller set 18 can also check the actuation of the Zener diode 104 in order to control the electromagnetic drive unit 16 and drive the electromagnetic coil 165 to perform charging and to turn off the water supply. When the micro controller set 18 determines to turn on or turn off the flushing of water and to perform charging, the capacitor matrix 13 can still be able to drive the electromagnetic drive unit 16.

The electromagnetic coil 165 is a latch type electromagnetic coil and electric current is only consumed during the switch on and switch off of the electromagnetic valve of the water flow passage. The electromagnetic valve can be formed by the transistor switches 161 to 164 or the elements packaged as an IC. The transistor switches 161 to 164 or the elements respond to the control signals of the micro controller set 18, turn on the positively and negatively electrified H bridge circuit of the electromagnetic coil 165 when an output port of the micro controller set 18 is at HI level, and turn off the positively and negatively electrified H bridge circuit of the electromagnetic coil 165 when another output port of the micro controller set 18 is at HI level.

For the automatic water supply control device 1, more electric power is consumed during the switch on and switch off of the electromagnetic valve of the water flow passage for flushing. However, the capacitor 12 is charged continuously by the micro hydro generator. During the standby mode, only very little electric power is consumed by the elements such as the micro controller set 18 and the sensing unit 15 for detecting signals and performing corresponding actions. But after a long period of standby mode, the amount of stored electricity reduces and the supply voltage of the step-down voltage conversion circuit 14 is reduced indirectly and gradually because of the electric consumption by the elements such as the micro controller set 18 and the sensing unit 15, or the electric leakage of the capacitor 12 and the capacitor matrix 13.

The step-down voltage conversion circuit 14 and the electromagnetic drive unit 16 are electrically connected with each other through the micro controller set 18. The micro controller set 18 receives the sensing signals sent by the sensing unit 15 to control the electromagnetic drive unit 16 to drive the electromagnetic coil 165, and the micro controller set 18 controls the electromagnetic drive unit 16 and drives the electromagnetic coil 165 to supply water and to perform charging based on a logical setting when a voltage value of the step-down voltage conversion circuit 14 is lower than a preset voltage value.

It should be noted that, the connection between the micro controller set 18 and the step-down voltage conversion circuit 14 is used for responding to the outputted voltage value of the step-down voltage conversion circuit 14. The step-down voltage conversion circuit 14 provides a stable outputted voltage value and the outputted voltage value of the step-down voltage conversion circuit 14 reduces because of the discharge of the capacitor matrix 13. If the micro controller set 18 detects that the outputted voltage value (voltage value of the LDO) of the step-down voltage conversion circuit 14 is reduced lower than a preset step-down voltage, it is regarded as a shortage of electric energy. Then, the micro controller set 18 controls the electromagnetic drive unit 16 to drive the electromagnetic coil 165 to turn on the water supply in order to drive the micro hydro generator to generate electric power, to charge the capacitor 12 and to increase the amount of electric energy stored in the capacitor 12. Furthermore, the micro controller set 18 can also check the actuation of the Zener diode 104 in order to control the electromagnetic drive unit 16 and drive the electromagnetic coil 165 to perform charging and to turn off the water supply. By using the step-down voltage circuit checking of the present invention, additional voltage checking circuit such as an AD for detecting the capacitor voltage is no longer required. Faster response can also be carried out for changes on the amount of electricity stored in the capacitor matrix 13 in order to ensure that the amount of electric power of the automatic water supply control device 1 is adequate for driving the switch to turn on the water supply at any time.

Figure 2:
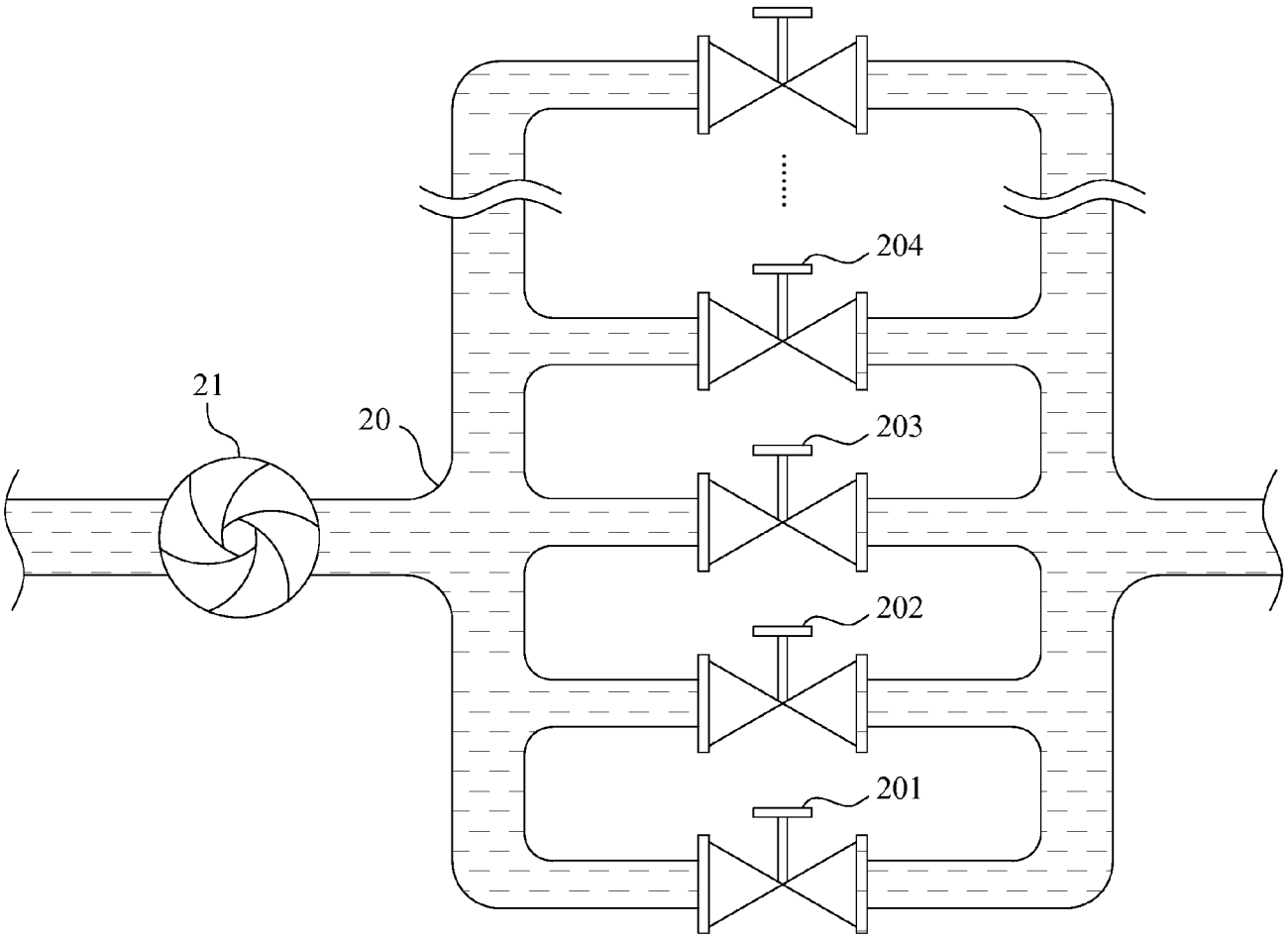
FIG. 2 is an illustration of a water current passage of the automatic water supply control device of the present invention.

FIG. 2 is an illustration of a water current passage of the automatic water supply control device of the present invention. More than one independently controlled water flow bypass can further be disposed for a water flow passage 20 for the automatic water supply control device 1. Control valves of the water flow bypasses can control the water flow independently and are not affected by the other water flow bypasses. A micro hydro generator 21 is disposed in the water flow passage 20 and the water flow bypasses are branched from the water flow passage 20. The valves include an electromagnetic control valve 201, a manual control valve 202, an air control valve 203, a hydraulic control valve 204, etc. The water flow can be controlled by the control valves independently and they are not limited or affected by the other water current bypasses. The types of the control valves are only used for descriptions and should not be construed as limitations to the disposing sequence and types of the control valves. Other suitable elements can also be used as the control valves. The control valves can control the water current independently and they are affected by the other water current bypasses. Thereby, the micro hydro generator 21 can be driven by the water current through many different ways of opening the valves in order to generate electricity. Furthermore, other elements can also be used for the expansion and control of other auxiliary devices, and therefore the application range and expandability of the automatic water supply control device 1 can be enhanced.

As a conclusion, the automatic water supply control device of the present invention has the following advantages:

1. By using the circuit layout of the present invention, a maximum amount of electricity can be stored in the capacitor and a maximum momentary output of electric current can also be achieved because of the capacitor matrix.

2. The micro controller set of the present invention can determine if the water supply needs to be turned on or not without having to detect the capacitor. Instead, the micro controller set drives the electromagnetic drive unit in order to drive the electromagnetic coil to turn on the water supply when the outputted voltage value of the step-down voltage conversion circuit (LDO) reduces.

3. The storing of electric energy is performed through the capacitor, and the momentary discharging of electric current is performed through the capacitor matrix composed of different capacitors. Conventional devices only equipped with the single large sized capacitor is slow in discharging momentarily, while the efficiency of response can be enhanced tremendously by using the capacitor matrix and the other type of capacitor of the present invention. Thereby, the automatic water supply control device of the present invention can operate more efficiently smoothly.

4. By using the capacitor matrix with the other type of the capacitor (super capacitor or electric double layer capacitor) of the present invention, the capacitor matrix can still supply power even if the amount of electric energy stored in the capacitor is in shortage or when there is a malfunction. The capacitor matrix and the capacitor are coordinated with each other.

5. By using the step-down voltage circuit checking of the present invention, additional voltage checking circuit is no longer required. Faster response can also be carried out for changes on the amount of electricity stored in the capacitor matrix in order to ensure that the amount of electric power of the automatic water supply control device is adequate for driving the switch to turn on the water supply at any time.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An automatic water supply control device, comprising: a power processing unit for processing an alternating current outputted by a micro hydro generator and providing a stable direct current; a capacitor electrically connected to the power processing unit for storing electric energy; a capacitor matrix in parallel connection with the capacitor and being separated from the capacitor by using a diode, the capacitor matrix being composed of more than two capacitors different from the capacitor and providing the electric energy required by an electromagnetic drive unit and a step-down voltage conversion circuit based on the direct current; the step-down voltage conversion circuit electrically connected to the capacitor matrix and a micro controller set for converting the voltage of the direct current and providing a direct current lower than the direct current of the power processing unit; the electromagnetic drive unit electrically connected to the capacitor matrix, and requiring a driving electric energy provided by the capacitor matrix; a sensing unit sensing changes from the environment and outputting sensing signals; and the micro controller set electrically connected to the step-down voltage conversion circuit, the electromagnetic drive unit, and the sensing unit for controlling the electromagnetic drive unit and driving an electromagnetic coil based on the sensing signals from the sensing unit, the micro controller set also controlling the electromagnetic drive unit and driving the electromagnetic coil to supply water and to perform charging based on a logical setting while an output voltage value of the step-down voltage conversion circuit is lower than a preset voltage value.

2. The automatic water supply control device as claimed in claim 1, wherein the micro controller set also checks the actuation of a Zener diode in order to control the electromagnetic drive unit and drive the electromagnetic coil to perform charging.

3. The automatic water supply control device as claimed in claim 1, wherein the capacitor is a super capacitor.

4. The automatic water supply control device as claimed in claim 1, wherein the capacitor is an electric double layer capacitor.

5. The automatic water supply control device as claimed in claim 1, wherein the step-down voltage conversion circuit is composed of a low dropout regulator (LDO regulator).

6. The automatic water supply control device as claimed in claim 1, wherein at least one independently controlled water current bypass is further disposed for a water current passage, and a control valve of each of the at least one water current bypass independently controls the water current without being affected by neighboring water current bypasses.

* * * * *